United States Patent [19]

Grosch

[11] 3,967,785

[45] July 6, 1976

[54] METHOD AND APPARATUS FOR PRODUCING DEFIBRATED CELLULOSE FLUFF FROM BALES OF COMPACTED WOOD PULP SHEETS

[75] Inventor: George S. Grosch, Lake Worth, Fla.

[73] Assignee: Curt G. Joa, Inc., Sheboygan Falls, Wis.

[22] Filed: Feb. 12, 1975

[21] Appl. No.: 549,252

[52] U.S. Cl. ..... 241/28; 241/101 A; 241/186 R

[51] Int. Cl.[2] ..... B02C 13/286

[58] Field of Search ..... 241/25, 28, 30, 34, 241/26, 51, 57, 86, 89.3, 101 A, 186 R, 189 R, 190, 278 R

[56] References Cited

UNITED STATES PATENTS

| | | | |
|---|---|---|---|
| 252,983 | 1/1882 | Werner | 241/28 |
| 2,561,069 | 7/1951 | Peterson | 241/101 A |
| 3,224,687 | 12/1965 | Bidwell | 241/278 R |
| 3,692,246 | 9/1972 | Law et al. | 241/28 |
| 3,743,191 | 7/1973 | Anderson | 241/190 |

*Primary Examiner*—Granville Y. Custer, Jr.
*Attorney, Agent, or Firm*—Joseph P. House, Jr.

[57] ABSTRACT

Method and apparatus for producing defibrated cellulose fluff from bales of stacked compacted wood pulp sheets. A face of such a bale or stack is advanced against a milling cutter. The milling cutter and bale are moved relative to one another in the plane of said face to sweep the cutter across all portions of the face and disintegrate the sheets. Fluff thus produced is drawn through a foraminous screen for further disintegration and defibration of the fluff particles. In preferred embodiments, the baled stack is rotated on a vertical axis over a milling cutter which rotates on a horizontal axis. The milling cutter is mounted beneath a bed having a port through which the periphery of the mill is exposed to the face of the bale.

17 Claims, 18 Drawing Figures

95
96
97
111
113
114
94
154
155
41
31
34
151
160
141
139
110
112
25
117
118
116
115
137
140
26
122
123
121
124
125
126
24
128
129
27
28
51
35
8
8
144
20
23
102
22
142
67
108
105
103
104
106
109
101
21
152
153
180
179

METHOD AND APPARATUS FOR PRODUCING DEFIBRATED CELLULOSE FLUFF FROM BALES OF COMPACTED WOOD PULP SHEETS

BACKGROUND OF THE INVENTION

Rolled pulp strips can be readily disintegrated into fluff by hammer mills or pin drums, as shown, for example, in Joa U.S. Pat. Nos. 3,016,582 and 3,268,954. The disintegrated fluff is then formed into a relatively thick batt used in the fabrication of disposable pads, such as sanitary napkins, hospital pads, diapers, etc. on apparatus shown, for example, in Joa U.S. Pat. No. 3,086,253. The technique utilized by the patents just mentioned utilizes a supply of pulp in the form of compacted wood pulp sheets, usually in roll form so that only a single or a very few layers of sheet pulp are presented endwise to the disintegrating mechanism.

Where compacted wood pulp sheets are supplied in the form of bales in which the sheets are stacked one on top of the other, they are hard to separate into sheet form, because the sheets tend to stick together. Accordingly, it has proven very difficult to commercially disintegrate the baled compacted pulp sheets into fluff. U.S. Pat. No. 3,692,246 of Sept. 19, 1972, and U.S. Pat. No. 3,804,340 of Apr. 16, 1974, illustrate examples of suggested techniques for dealing with stacked sheets or bales of compacted wood pulp. In both of these patents multiple stages of disintegration are necessary. The first stage breaks the bale down into chips and the second stage reduces the chips to fluff. The necessity for multiple stages increases the cost of the apparatus. Moreover, the first stage shredder acts on the edge of the bale or stack, this being a relatively tough part of the bale as the sheets are laminated together and the edge of one sheet reinforces the next.

SUMMARY OF THE INVENTION

In accordance with the present invention, complete disintegration of the bale into fluff is accomplished in a single stage. Moreover, a milling cutter acts against the face of the bale, rather than against its edge. The face is softer than the edge and more susceptible to milling action. The bale and cutter are moved relative to one another in the plane of the bale face so that the entire face of the bale is swept or traversed by the milling cutter. The blades of the milling cutter bite into the face of the bale and penetrate for only a short distance into the bale, for example, the thickness of one, two or three sheets. In this manner, entry of the cutting mill blades into the bale is made at relatively soft parts of the bale, inasmuch as the bale face is softer than its edges.

In preferred embodiments, the bale is lowered onto a bed which has a port through which the periphery of a horizontal axis hammer mill cutter is exposed. The bale is then rotated on a vertical axis to sweep all parts of the bale face over the rotating hammer mill while the hammer mill blades defiberize the cellulose fibers into fluff. The hammer mill is desirably provided with the usual hammer mill screen through which the fluff is drawn to further disintegrate the fluff. Accordingly, in the fluff characteristically produced in accordance with the present invention, the fibers are well broken down into individual fibrous form and are uniformly distributed without clumps.

The bales are typically square in outline. The apparatus of the present invention includes a bale cradle adjacent the cutter which has a shape corresponding to the outline of the bale. The cradle is turned to transmit turning torque to the bale to sweep the bale face across the cutter. The bale rests by gravity on a bed having a port through which the periphery of the cutter is exposed to the bale face. The cutter is adjustable toward and away from the bed to adjust the depth of cut and insure uniform feed of the bale against the cutter.

As disintegration of the bale continues, it will become reduced in height. At a selected level of height reduction, a fresh bale is loaded into the cradle on top of the partially reduced bale and the process continues.

The bale is primarily supported on the bed. The bale portions which span across the port will tend to sag somewhat into the port. The position of the milling cutter with respect to the bed is adjustable so that the depth of penetration of the mill blades into the bale face can be adjusted to the optimum amount.

The edge of the port is desirably beveled to a knife edge which coacts with the rotating cutter blades to produce an effective shearing or cutting action on pulp portions torn from the bale face. The port is long enough to extend past the edge of the bale. Suction is produced beneath the port to draw air through the extended portion of the port, thus to aerate and convey the fluff in a stream of air through the cutter screen and to batt forming apparatus.

Apparatus is also provided to align the cradle with a fresh bale and control mechanism is provided to stop rotation of the cradle, deposit the fresh bale into the cradle and to restart cradle rotation, all automatically for substantially continuous processing of successive pulp bales into fluff.

Other objects, features and advantages of the invention will appear from the following disclosure.

DESCRIPTION OF THE DRAWINGS

FIG. 17 is a fragmentary side view of the milling cutter of FIG. 3.

DESCRIPTION OF THE PREFERRED EMBODIMENT

Figure 1:
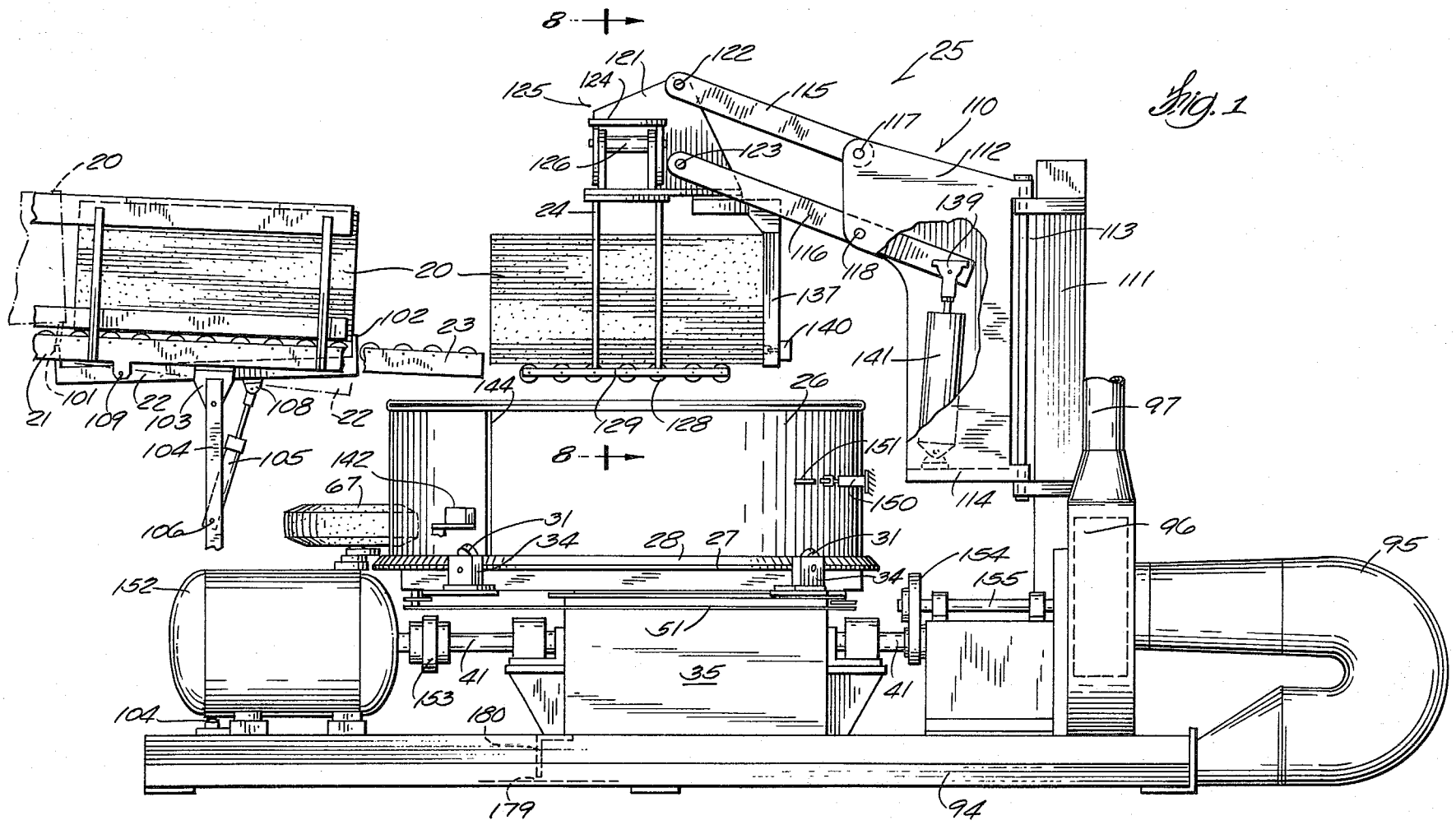
FIG. 1 is a side view of apparatus embodying the invention. This view also illustrates the technique of advancing fresh bales toward the defiberizing mechanism.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Like parts are given the same reference characters in the several views.

As best shown in FIG. 1, bales 20 comprising stacked rectangular sheets of compacted wood pulp travel on roller conveyor 21 to an escapement mechanism 22 which feeds bales 20 one at a time across an intermediate roller conveyor 23 into the arms 24 of a claw carrier or sling 25 by which the bales 20 are lowered into the tub 26 of the disintegrating mechanism. Tub 26 is desirably in the shape of a cylindrical drum having at its lower edge a support and a reinforcing ring 27 with a beveled upper edge 28.

Beneath tub 26 is a support rail 29 mounted on edge on the cross beams 39 of frame 35. At intervals around rail 29 are disposed brackets 30 from which project support rollers 32 and hold-down rollers 31. (FIGS. 2, 7 and 11) Support rollers are beneath support ring 27 and hold-down rollers 31 overlie beveled edge 28. Accordingly, tub 26 may rotate about a vertical axis, but it cannot move vertically.

Figure 16:
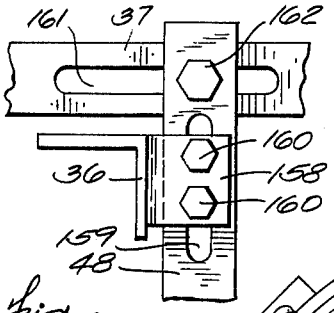
FIG. 16 is an enlarged fragmentary cross section along the line 16—16 of FIG. 3.

At its inside the tub 26 is provided with a cradle 38 comprising four angled corner posts 36 held in rectangular assembled relationship by spaced parallel frame rails 37 which are rigidly fastened to the tub 26, and spaced parallel frame rails 48 which are slidably fastened to rails 37, as hereinafter described. The cradle corner posts 36 are adjustable on their frame rails 37, 48 so as to constitute a cradle of the proper size to receive and embrace the rectangular bale 20. For different bale sizes the connection of the corner posts 36 to the frame rails 37, 48 can be adjusted. Each corner post 36 is provided with a bracket 158 which overlies frame rails 48. Rails 48 have slots 159 (FIG. 16) to receive bolts 160 by which corner posts 36 can be shifted longitudinally along frame rails 48. The transverse frame rails 37 have longitudinal slots 161 and the ends of frame rails 48 overlie slots 161 and are adjustably fastened thereto by bolts 162. Accordingly, the corner posts 36 may be moved in all directions within the tub 26 to enlarge and reduce the size of the rectangle outlined thereby.

Figure 3:
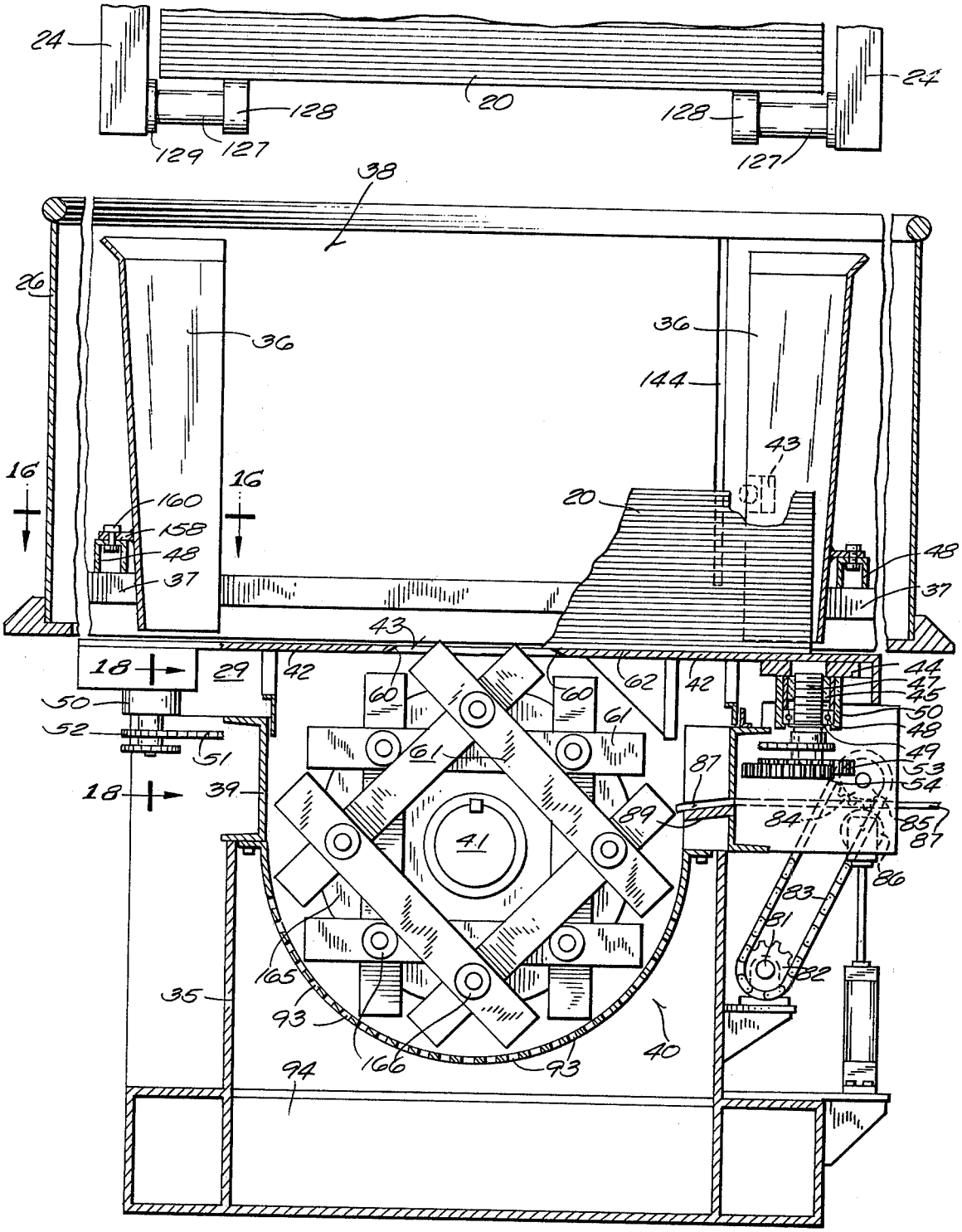
FIG. 3 is a vertical cross section taken through the milling cutter and tub receptacle, along the line 3—3 of FIG. 2, and showing the relationship between the mill and a bale of stacked pulp sheets therein.

Beneath the tub 26, frame 35 supports a hammer mill or like cutting mill 40, one embodiment of which is shown in FIG. 3. Cutting mill 40 is provided with a horizontal shaft 41 powered by motor 152. The cutting mill 40 may embody various forms of cutting blades, hammers or knives, as will hereinafter be described in more detail.

Between the cutting mill 40 and the bale 20 in cradle 38 is a support bed or plate 42 which has a rectangular port 43 through which the upper periphery of the cutting mill 40 is exposed to the bottom face of the bale 20.

Figure 18:
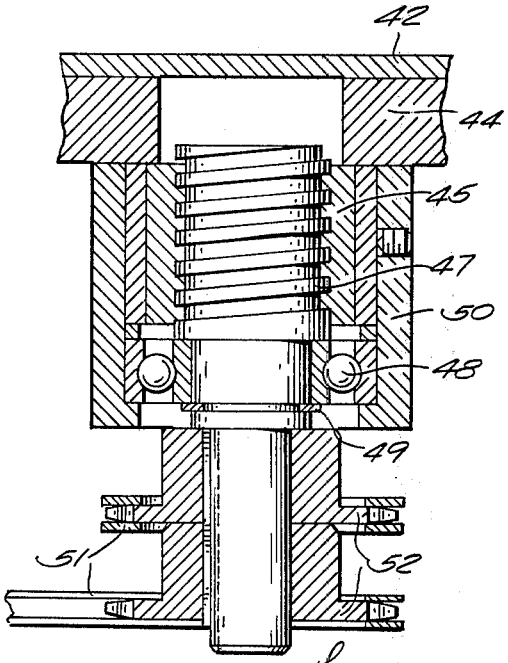
FIG. 18 is an enlarged cross section taken along the line 18—18 of FIG. 3.

Bale 20 is primarily supported on the bed 42 and the bed is adjustable vertically for the purpose of adjusting the milling or cutting relationship and depth of cut of the blades 61 on the mill 40 with respect to the bale 20. For this purpose each of the four corners of the bed 42 is provided with a support pad 44 and a nut 45 (FIG. 18). Through each nut 45 extends a screw jack 47, journaled in a box 50 affixed to the pad 44. The bearings 48 and snap ring 49 in box 50 restrain the screw jack 47 from axial movement, but permit it to rotate.

All four of the screw jacks 47 are interconnected by a series of chains 51 passing about corresponding sprockets 52 on the several jacks. At the lower end of one of the screws 47 gears 53, 54 are provided and these gears connect to a gear box 55 provided with a crank handle 56 by which screws 47 can be turned simultaneously to exert lifting or lowering pressure on the four corner pads 44 of the bed 42. Accordingly, the bed 42 and bale 20 can be lifted and lowered with respect to the cutting mill 40 and hence the depth of cut or bite of the cutting blades on the cutting mill with respect to the bale can be readily adjusted.

Port 43 in bed 42 is substantially rectangular along the major portion of its length, thus to outline a peripheral sector of the horizontally elongated cutting mill 40. In the embodiment shown in FIGS. 2, 4, 5 and 6, the port 43 is laterally enlarged near one of its ends at 57 for a purpose to be hereinafter explained.

Figure 12:
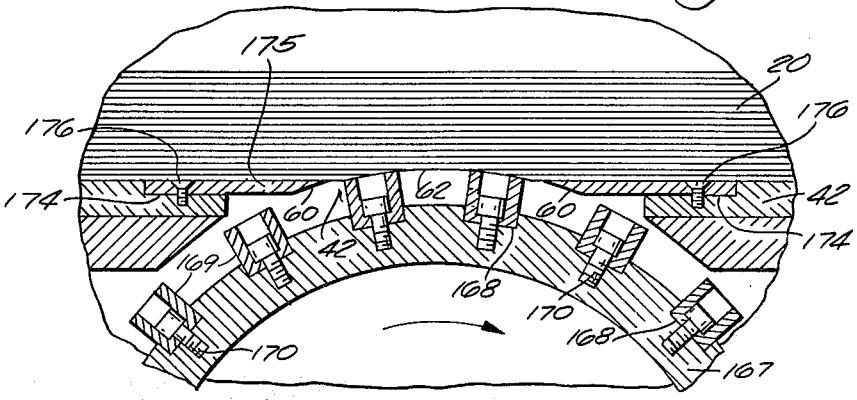
FIG. 12 is a fragmentary cross section taken through a modified embodiment of the cutter mill, shown in association with a bale on its bed.

The edges of the bed 42 which outline the port 43 are desirably beveled at 60, as shown in FIG. 3, to provide a shearing edge which cooperates with the mill blades, as hereinafter explained. While the edges of the bed itself can be beveled as shown in FIG. 3, the arrangement shown in FIG. 12 is preferred, in which separate plates 175 having knife edges 60 are let into suitable recesses 174 formed in bed 42. Bevel 60 is desirably at about a 23° angle to the horizontal, thus to approximately match the arc of rotation of the mill blades 61 as they rotate past the edges 60. The arc of blade tip rotation should be spaced about ⅛ to ¼ inch from the knife edge 60. The individual pulp sheets in bale 20 are typically about 1/16 inch thick. Mill 40 is rotated at about 3,500 rpm. With a mill circumference of about 5 feet, the blade tip speed is about 17,500 fpm.

When a bale 20 of stacked compacted wood pulp sheets is positioned in the cradle 38, as illustrated in FIG. 3, and the tub 26 is rotated, the lower face 62 of the bale will slide across the bed 42 and the portion of the face 62 over the port 43 will sweep across the cutting zone of the mill blades 61.

Figure 7:
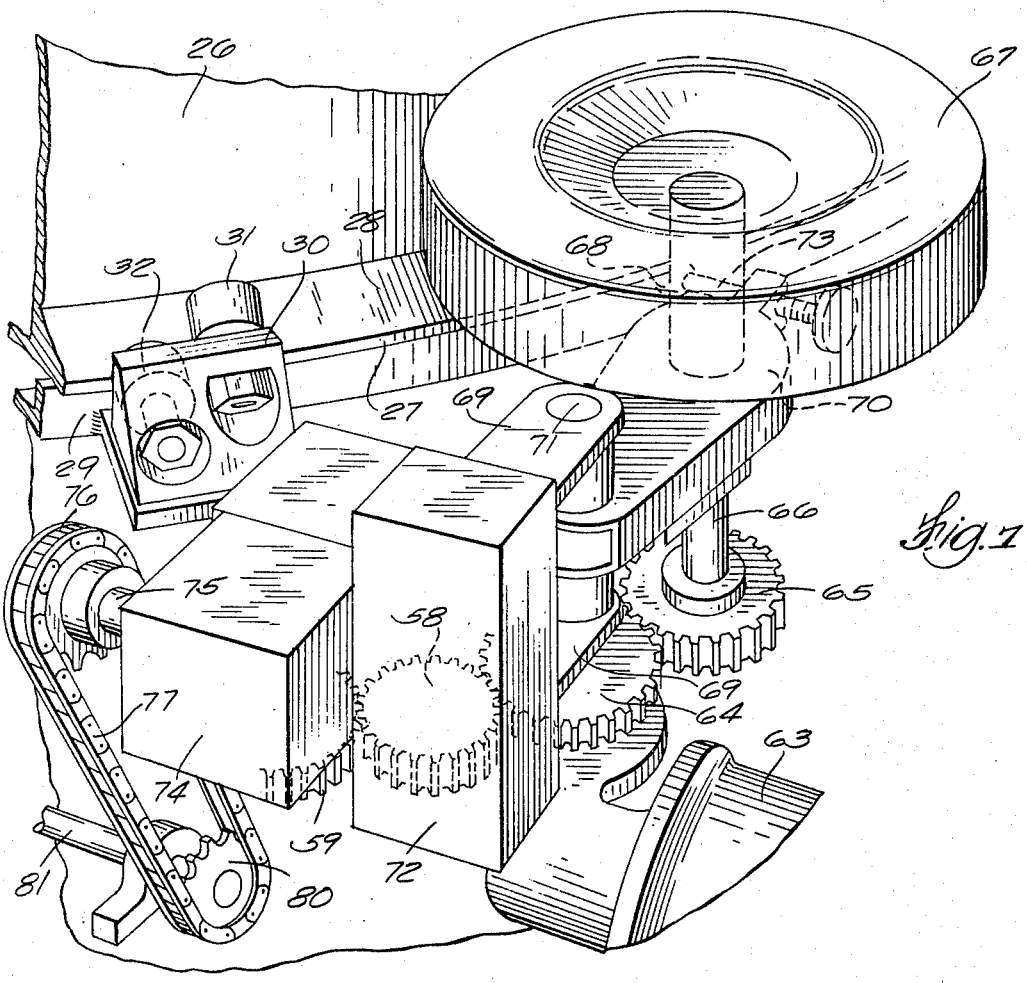
FIG. 7 is an enlarged fragmentary perspective view of the apparatus for rotating the tub and cradle.

Tub 26 is rotated at about ten rpm by the variable speed electric motor 63 which is connected through the gears 64, 65 to the shaft 66 of a rubber tire drive wheel 67 which bears against the side of the tub 26 to rotate the tub (FIG. 7). Shaft 66 of drive wheel 67 is mounted on a swing arm 70 which is mounted on a pintle 71 which spans between bracket arms 69 fixed to a frame post 72. The position of wheel 67 is adjusted by screw 73 having one end attached to swing fitting 68 anchored on support rail 29.

Output gear 64 from motor 63 also drives speed change mechanism in gear box 74 through gears 58, 59. The output shaft 75 of gear box 74 is provided with a sprocket 76 driving through a chain 77 to a sprocket 80 on a shaft 81 to a sprocket 82 and chain 83 (FIG. 3) which drives the sprocket 84 on an infeed roller 85 having an opposed roller 86 for the purpose of feeding a pulp strip 87 from a roll 90 of pulp which is mounted on a mandrel 91 from roll stand 92.

As best shown in FIG. 3, such a pulp strip 87 may be fed laterally into and against the edge of the milling cutter 40, over breaker bar 89. Accordingly, the machine is adapted to process both baled pulp 20 and a continuous roll of pulp 90 so that either form of pulp can be processed and disintegrated into fluff.

In the cutting mill 40 of FIGS. 3 and 17, the blades 61 comprise steel strips having their ends projecting radially beyond support disks 165 having axially extending bolts 166 to which the strips 61 are fastened. A series of axially stacked blade strips 61 are arranged as shown in FIGS. 3 and 17, thus to present multiple edges at the tips of the blades 61 for action on the pulp bale 20.

Figure 13:
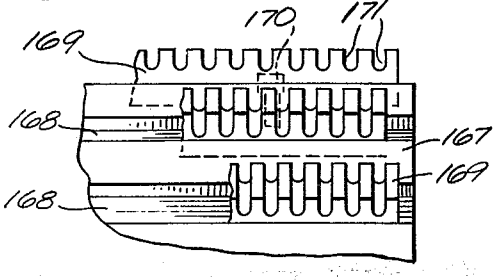
FIG. 13 is a fragmentary side view of the modified cutter mill of FIG. 12.
Figure 11:
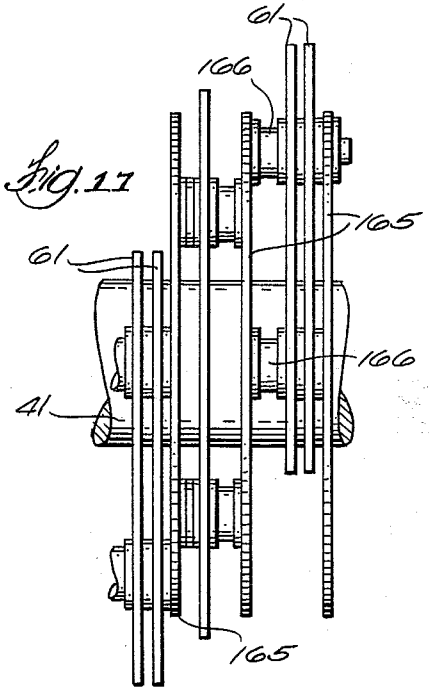

A different form of milling cutter is illustrated in FIGS. 12 and 13. A drum 167 has axial slots 168 milled in its periphery to receive toothed blades 169 therein. The blades 169 have countersunk bolts 170 which detachably affix the blades 169 to the drum. The blades 169 are staggered axially of the drum to axially offset the teeth 171 on one blade 169 with respect to the teeth on the adjacent blade 169. This insures good coverage of the bale face by the teeth on the mill.

As best shown in FIG. 12, the bed 42 is desirably provided with shallow recesses 174 adjacent port 43. Removable plates 175 are received in said recesses and are fastened to the bed by bolts 176. The edges of the plates which bound port 43 are beveled at 60 to provide sharp knife edges which have a shearing action on pulp torn from the pulp bale face by the teeth on blades 169 as the mill rotates (clockwise in FIG. 12).

In both embodiments of FIGS. 3 and 12, the desired spacing of the blade tip circle and the knife edge 60 is about ⅛ to ¼ inch. This results in said shearing action on the pulp particles between the blade tips and the knife edge 60.

From the foregoing it is clear that the exact form of milling cutter 40 is not critical. Various forms can be used to advantage. Pulp fibers will be torn out of the face 62 of the bale 20 by rotation of the mill 40. Typically, the bed 42 will be adjusted so that the milling blades 61, 168 will penetrate or bite into one, two or three sheets of pulp in the bale stack 20. Each pulp sheet is about 1/16 inch thick so that the maximum cut will be about 3/16 inch. At the high speed of rotation of the mill and a relatively shallow cut into the face of the bale, good defibration of the pulp is achieved.

The mill 40 is also desirably provided with a foraminous screen 93 which is disposed closely adjacent to the tips of the mill blades 61, 168. Further disintegration of the fluff occurs between blades 61, 169 and screen 93. Beneath the screen 93 is a discharge duct 94 (FIG. 3) which is connected as best shown in FIG. 1 through a ductwork 95 to the eye of blower 96 and thence through duct 97 to a batt forming apparatus such as shown in Joa U.S. Pat. No. 3,086,253.

The laterally extended portions 57 of port 43 project in large measure beyond the edge of the bale 20. (FIGS. 2, 4 and 5) Accordingly, these portions 57 are exposed to the atmosphere and air is sucked through these portions into the mill 40. Fluff produced from the bale 20 is aerated and is entrained in a stream of air and is pulled into and through the screen 93 where further disintegration and comminution of the fluff occurs, as the fluff is pulled through the screen holes. These holes are desirably approximately ⅜ inch in diameter.

It is an important feature of the invention that the mill blades act upon the face of the bale 20, rather than on the edges thereof. The face of the bale is relatively soft as compared to the edges thereof and the fibers can be pulled out of the face of the bale much more readily than from its edges. Moreover, it is an important characteristic of the present invention that the bale face is presented to the blades of the hammer mill with a substantially uniform depth of cut. In accordance with the present invention, uniformity of depth of cut can be regulated by the mechanism for raising and lowering the bed 42 as hereinbefore described.

Figures 2, 11:
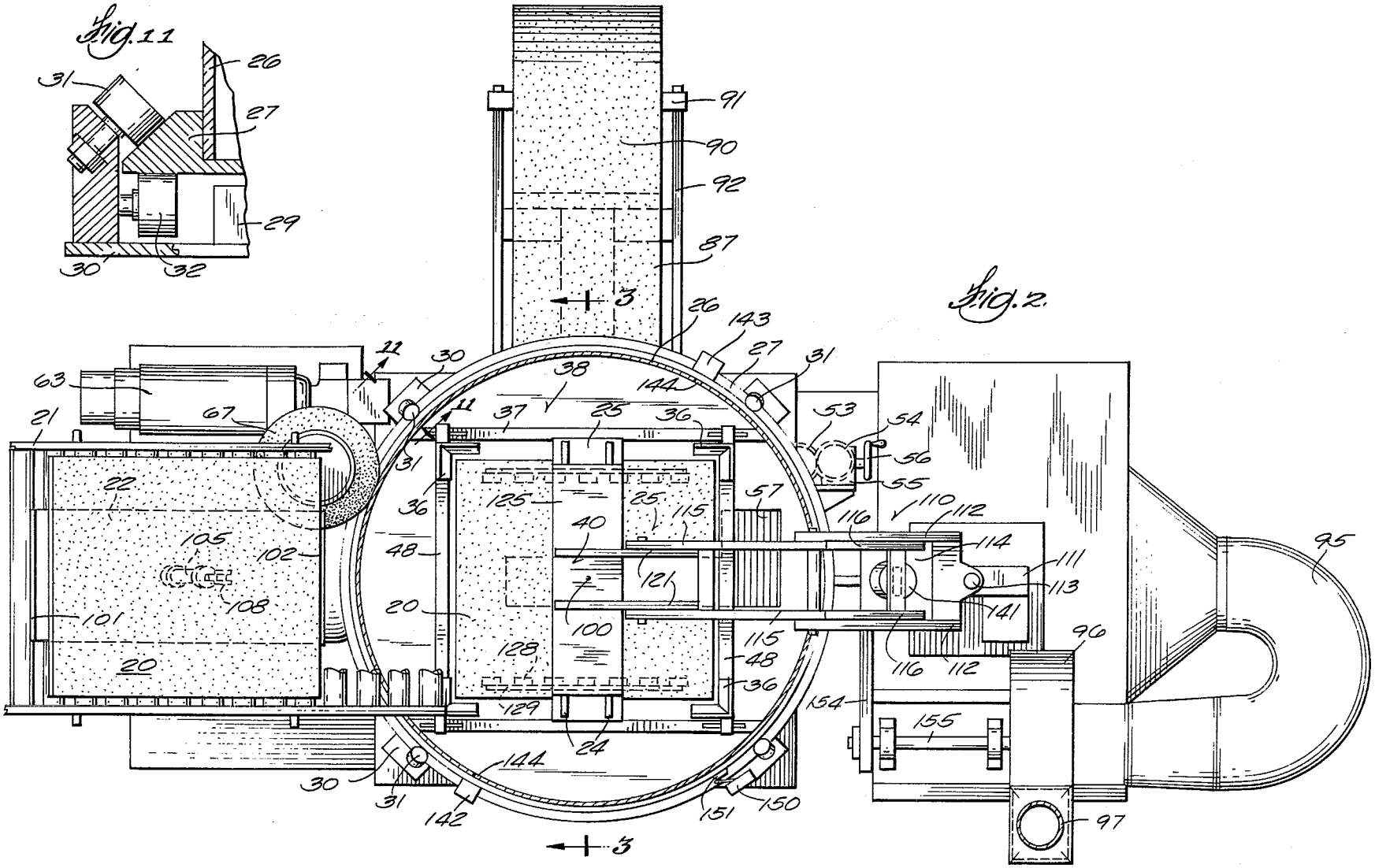
FIG. 2 is a top view of the apparatus shown in FIG. 1.
FIG. 11 is a fragmentary cross section along the line 11—11 of FIG. 2.
Figure 4:
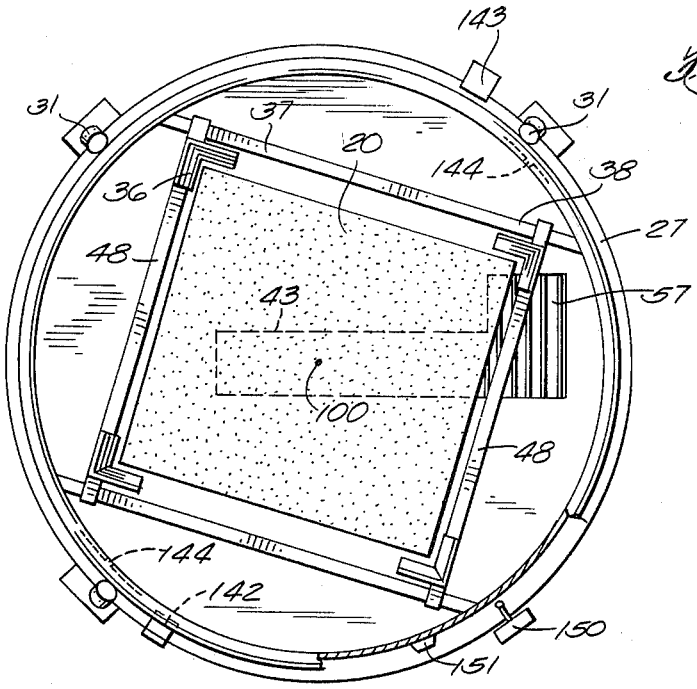
FIG. 4 is a diagrammatic plan view showing the cradle rotated somewhat beyond its position shown in FIG. 3 and illustrating the manner in which the bale is swept across the port.
Figure 5:
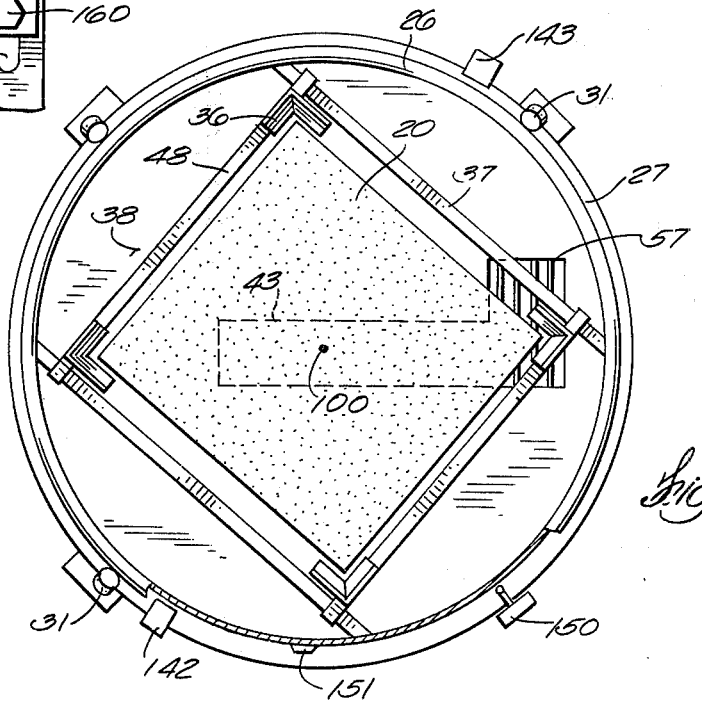
FIG. 5 is another diagrammatic view similar to FIG. 4, but showing a further advanced position of the cradle.
Figure 6:
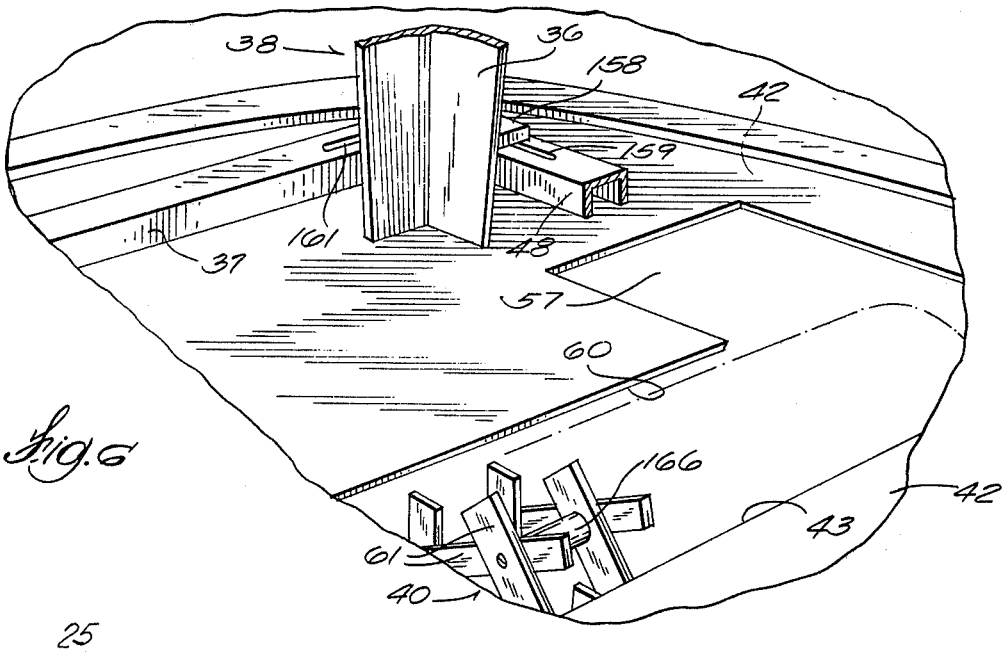
FIG. 6 is a perspective view taken inside of the tub and with the bale removed and showing the relationship between the tub bed with its port and the underlying milling cutter.

FIGS. 2, 4 and 5 illustrate successive positions of the bale 20 as the tub 26 and cradle 38 rotate the bale 20 with respect to the port 43. Note particularly that the enlarged portion 57 of the port is always exposed beyond the edge of the bale 20, thus to provide ample port area for the drawing in of air to aerate and convey the fluff. As the bale face is rotated and swept across the port 43, all of the areas of the face will sweep past the cutting mill in one revolution of the tub.

Figure 15:
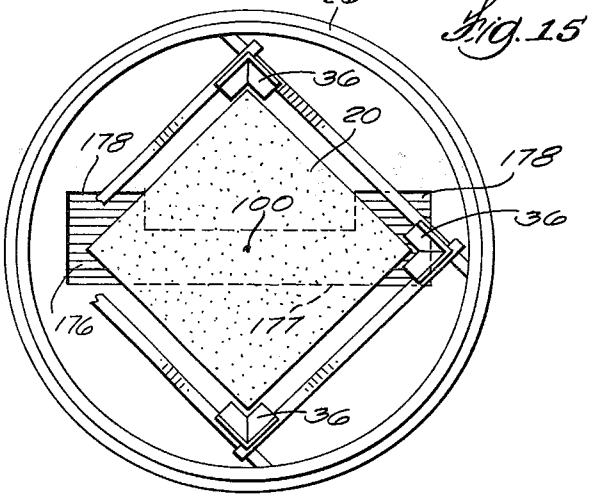
FIG. 15 is a view similar to FIG. 14 and showing the bale turned with respect to the mill.
Figure 14:
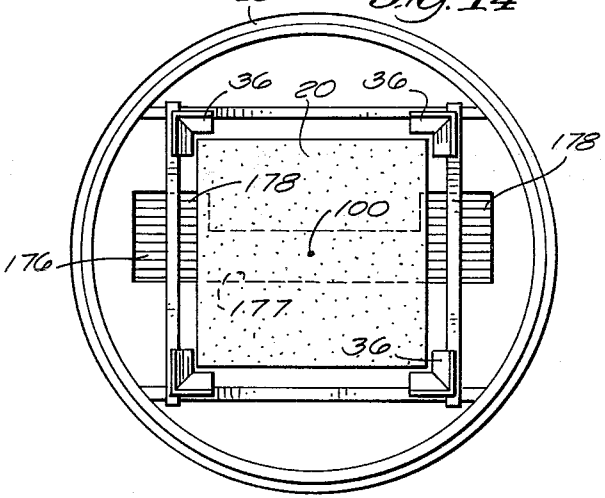
FIG. 14 is a diagrammatic plan view showing a bale over a modifed mill which is longer than the mill shown in FIGS. 4 and 5.

In the embodiment illustrated in FIGS. 2, 4 and 5, the vertical axis 100 on which the bale 20 is rotated is eccentric with respect to the port 43. Thus, the axial extent of mill 40 and its port 43 is shorter than the diagonal of the bale 20, as clearly appears from FIG. 5. However, inasmuch as the port 43 is eccentrically related to the vertical axis 100, all portions of the face of the bale will sweep across the port in a single revolution of the bale. In the embodiment illustrated in FIGS. 14 and 15, both the mill 176 and the port 177 are longer than the mill and port in the embodiment of FIGS. 2, 4 and 5, and the axis of rotation 100 of the bale 20 is substantially on the midpoint of the longitudinal extent of the mill 176 and port 177. Moreover, both ends of port 177 are provided with enlargements 178. Accordingly, both ends of the port will extend beyond the edges of the bale to admit air under suction of the blower 96. Moreover, all portions of the bale face will be swept across the mill in one-half revolution of the bale. The corners of the bale will also have increased exposure to the mill, as compared to the embodiment of FIGS. 2, 4 and 5.

Fresh bales 20 of stacked compressed cellulose wood pulp sheets are brought to the disintegrator on the roller conveyor 21 which is supported on legs 104 having a bracket 103 interconnecting the frame and legs. The escapement mechaism comprises a frame 22 beneath the discharge end of the conveyor 21. Frame 22 has front and rear upwardly projecting rails 101, 102 which are spaced apart longitudinally of the conveyor 21 for a distance slightly exceeding the length of the longest bale 20. Near its upstream end, frame 22 is pivotally mounted on the side rails of the conveyor 21 on hanger brackets 109. The escapement mechanism is actuated by a fluid motor 105 which has one end pivotally mounted at 106 to the pedestal 104 and has its other end pivotally mounted on bracket 108 to frame 22 at a point well offset from hanger brackets 109. Accordingly, actuation of the motor 105 will selectively tilt the frame 22 about the fulcrum provided by brackets 109 to alternately raise one or the other of the rails 101, 102 into the path of an advancing bale 20. As shown in FIG. 1, rail 102 in its full line position projects upwardly beyond the top edges of the rollers of conveyor 21, thus to arrest movement of the endmost bale. When the frame 22 is tilted clockwise to its broken line position in FIG. 1, rail 102 will drop below the level of the rollers so that endmost bale 20 will proceed by gravity over the intermediate roller conveyor 23 toward the sling 25. Concurrently, rail 101 will be elevated to lift the next succeeding bale off of the rollers and hold this bale in position. When the frame 22 is then tilted counterclockwise to its full line position in FIG. 1, rail 101 will drop below the level of the rollers to permit gravity advance of the next succeeding bale and, by the time that bale arrives at the end of the conveyor, it will be arrested in endmost position by the rail 102 which is now above the level of the rollers.

Figure 9:
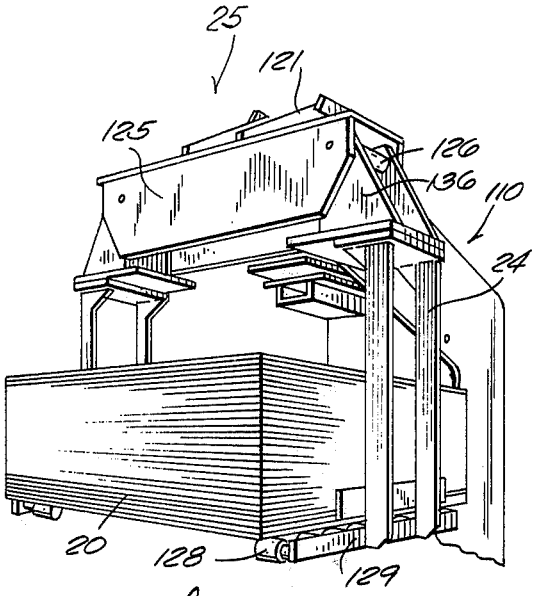
FIG. 9 is a perspective view of the claw carrier.
Figure 8:
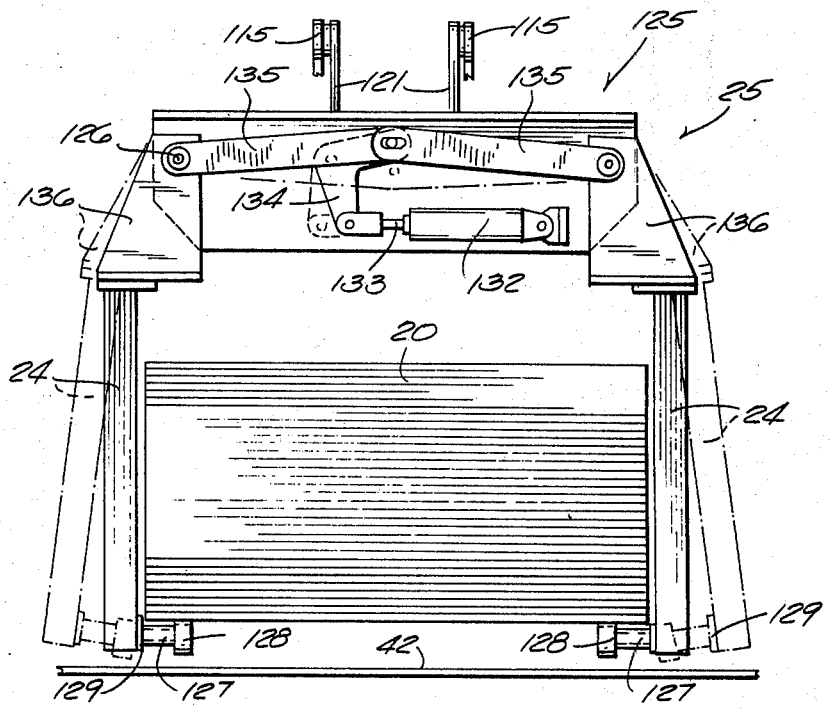
FIG. 8 is a fragmentary cross section of the claw carrier for handling a fresh bale. This view is taken along the line 8—8 of FIG. 1.

The sling or claw carrier 25 which feeds bales 20 vertically into the cradle 38 is mounted on a fixed mast 111. Mast 111 carries a swing bracket 110 which is pivotally attached to mast 111 on a vertically elongated pintle 113. Swing bracket 110 comprises spaced plates connected across their lower edges by a base plate 114. Cross pintles 117, 118 which span between plates 112 respectively carry pairs of upper links 115 and lower links 116 which comprise a parallelogram linkage support for the sling 25. The forward ends of the parallelogram linkages 115, 116 are pivotally connected to the spaced side plates 121 of a sling head bracket on pivot pins 122, 123 respectively. The sling head bracket side plates 121 are provided with notches 124 which receive a hollow, laterally extending box section beam 125 (FIGS. 1, 8 and 9). The ends of beam 125 pivotally support claw-like arms 24 on pintles 126 through box section brackets 136 at the upper ends of arms 24. At their lower ends, arms 24 are provided with fore and aft extending rails 129 from which jack shafts 127 project inwardly. The jack shafts 127 support rollers 128 which provide a retractable support for a bale 20.

Inside the hollow beam 125 power-operated mechanism is provided to swing the arms 24 between their respective full and broken line positions shown in FIG. 8. This mechanism includes a fluid motor 132, the piston rod 133 of which is pivotally connected to a bell crank 134 which has its other end pivotally connected to corresponding ends of crank arms 135 which in turn have their other ends fixed to the arm brackets 136.

Sling 25 is also provided with a backboard 137 (FIG. 1) which arrests movement of the bale 20 as it arrives from intermediate conveyor 23 onto the rollers 128 which are then in their full line position as shown in FIG. 8. The backboard 137 carries a limit switch 140 which is actuated by the pressure of the bale 20 when it arrives on the sling 25.

The lower set of parallel linkages 116 are rearwardly extended from pintle 118, as shown in FIG. 1, and the rearward extensions function as lever arms. Arms 116 are cross connected by stretcher 139 to which a fluid motor 141 is pivotally connected and by which the sling 25 is raised and lowered.

As best shown in FIG. 2, when a fresh bale 20 is positioned on the sling 25, the bale is vertically aligned with the space between the cradle corner posts 36 so that when the sling is lowered the bale will be received within the cradle 38.

To deposit the bale 20 in the cradle 38, the fluid motor 141 is actuated to swing the parallel links 115, 116 downwardly until the fresh bale 20 is just above the bed 42, or a partially exhausted previous bale 20. Fluid motor 132 (FIG. 8) is then actuated to retract the arms 24 outwardly from their full to their broken line position shown in FIG. 8. This removes the rollers 128 from supporting relationship to the bale 20 and it will fall by gravity either onto the bed 42 or onto the top of a preceding bale 20. At this time the bale sides will be laterally embraced by the corner posts 36 and lateral movement of the arms 24 cannot misalign the bale.

In some embodiments of the invention it is desirable to stop the rotation of the tub 26 and align the tub cradle 38 with the fresh bale 20 on sling 25, before the fresh bale 20 is lowered onto the cradle 38. For this purpose, and for sensing when a partially exhausted bale has been reduced in height to a sufficient extent to make it appropriate to load a fresh bale into the tub 26, the tub 26 is provided with control mechanism as will now be explained.

At opposite sides of the tub 26 are mounted a photocell light beam sensor or receiver 142 and a photocell light source 143 (FIGS. 1, 2, 4 and 5). At diametrically oppositely disposed portions of its side wall, the tub 26 is provided with vertically extending slots 144 which will come opposite the light source 143 and photocell 142 when the tub 26 is in its position shown in FIG. 2 in which the cradle 38 aligns with the fresh bale 20 on the sling 25. In this position the photocell sensor 142 will "see" or sense the light beam from light source 143 through the slots 144, if the height of a partially exhausted bale 20 in the tub has dropped to the point where it does not obstruct the light beam. This situation is illustrated in FIG. 3 where the top of the partially exhausted bale 20 is at the level of the beam.

Figure 10:
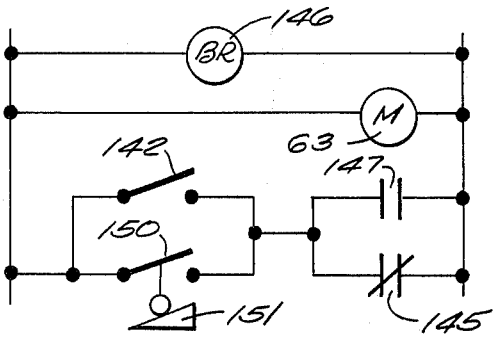
FIG. 10 is a simplified schematic electric circuit diagram.

Motor 63 which drives the tub 26 may be wired in the circuit illustrated in FIG. 10 in which the motor is controlled by a relay 145 which is in circuit with the photocell sensor 142. Motor 63 includes an integral electromagnetically actuated brake 146 controlled by relay 147 which is also in circuit with the photocell sensor 142. In addition, there is a cam-operated switch 150 in parallel with photocell sensor 142. Switch 150 is actuated by cam 151 mounted on the side of the tub (FIG. 1). The cam is so related to the slot 144 in the side of the tub that the cam-operated switch 150 is actuated each time the slots 144 align with the beam of light from light source 143 to the sensor 142.

In operation, the circuit of FIG. 10 functions to maintain the motor 63 energized and driving the tub 26 as long as the partially exhausted bale 20 is of a height sufficient to interrupt the light beam. Each time the slots 144 intersect the light beam, cam-operated switch 150 will open. However, if the photocell 142 is not actuated to the circuit to the relays 145 and 147 remains closed in which event the motor 63 remains actuated and brake 146 is released. However, when the photocell beam is broken, then both switches 150 and 142 will open when the slots 140 align with the beam, whereupon motor relay 145 will be actuated to deenergize the motor 63 and brake relay 147 will be actuated to apply brake 146, thus to stop the tub in its position shown in FIG. 2.

The actual physical location of cam 151 on the side of tub 26 can be adjusted somewhat circumferentially around the tub to take into account the short time span that it takes the tub to drift to a stop. In practice, both the switches 142, 150 are set to be actuated a predetermined number of degrees ahead of the drum position in which cradle 38 is aligned with bale 20 on sling 25. The brake 146 will stop the drum in this number of degrees of drift.

As aforesaid, fluid motor 141 will also be actuated when the tub is stopped, thus to lower the fresh bale 20 into the cradle 38. When the fresh bale comes to rest on top of the partially exhausted bale 20, the photocell beam will again be interrupted and switch 142 will close, thus restoring the circuit to the relays 145 and 147, to re-energize the motor 63, release the brake 146 and resume rotation of the tub 26.

The mill 40 is driven by a heavy-duty motor 152 connected to the shaft 41 of the mill through a suitable coupling 153 (FIG. 1). The other end of shaft 41 is connected through belt drive 154 to the shaft 155 which is connected to the impeller on blower 96.

As best shown in FIG. 1, an additional supply of air for conveying the fluff through duct 94 may be provided by providing a small opening 179 in duct end wall 180.

I claim:

1. A method of producing defibrated cellulose fluff from wood pulp sheets baled in stacks of such sheets and comprising the steps of advancing a face of such a stack against a rotary cutting mill having a curved periphery, rotating the cutting mill on a horizontal axis with a portion of its curved periphery exposed to the face of the stack, and rotating the stack on a vertical axis to move it horizontially and produce relatively motion in the plane of said face between the stack face and the curved periphery of the cutting mill.

2. A method of producing defibrated cellulose fluff from wood pulp sheets baled in stacks of such sheets and comprising the steps of advancing a face of such a stack against a milling cutter and producing relative motion in the plane of said face between the stack face and cutter, said cutter comprising a rotary cutting mill rotating on a horizontal axis, said stack being primarily supported on its said face on a bed which has a port through which said face is exposed to the cutting mill, the portion of the stack above said port being biased by gravity against the periphery of the cutting mill.

3. The method of claim 2 in which the horizontal movement of the stack is produced by rotating it on a vertical axis.

4. The method of claim 3 in which the stack is embraced in a cradle which is rotated on said vertical axis to impart such rotary motion to the stack.

5. The method of claim 4 in which a fresh baled stack is added to a partially exhausted stack which is undergoing processing after the partially exhausted stack has been substantially reduced in height and comprising the steps of positioning the fresh stack above the cradle, stopping the rotation of said cradle with the cradle aligned with the fresh stack, lowering the fresh stack into the cradle and onto the top of the partially exhausted stack and resuming rotation of the cradle.

6. The method of claim 5 plus the step of sensing the height of the partially exhausted stack as a prerequisite to the step of stopping the rotation of the cradle.

7. The method of claim 2 plus the step of adjusting the depth of cut of the mill by adjusting the relative position of the mill with respect to the bed.

8. The method of claim 2 in which the port has a portion extending beyond the stack in all positions thereof, said method including the step of drawing air through said port portion to aerate the fluff and convey it to batt forming apparatus.

9. The method of claim 2 in which the port has a knife edge, said rotary cutting mill being rotated on a path in which cutting mill blades shear pulp particles against said knife edge.

10. Apparatus for defibrating cellulose fluff from compacted wood pulp sheets baled in stacks of such sheets and comprising a rotary cutting mill having a horizontal shaft, a bed above the cutter, said bed having a port through which the periphery of the cutting mill is exposed, a bale cradle above the bed, means for depositing bales of such stacked wood pulp sheets into said cradle to dispose a portion of the face of such stack against the periphery of the cutting mill through said port, and power means for rotating the cradle and contained bale on a vertical axis and producing relative motion in the plane of said face between the stack face and said cutter to sweep all portions of said face over said port and against said cutter.

11. The apparatus of claim 10 in which said port has a knife edge, said cutter having blades which rotate in close proximity to said knife edge to shear pulp particles therebetween.

12. The apparatus of claim 10 in which said milling cutter comprises a rotary mill, one portion of the periphery of which rotates across said port, and a formainous screen curved about another portion of the cutter periphery and through which fluff cut from the bale is forced, in combination with a blower for impelling air through said screen to aerate and convey said fluff.

13. The apparatus of claim 10 in which said port has a portion which extends beyond the edge of the bale, and a blower for drawing air through the extended portion of said port and through said milling cutter for aerating and conveying said fluff.

14. Apparatus for defibrating cellulose fluff from compacted wood pulp sheets baled in stacks of such sheets and comprising thereabove rotary cutting mill having a horizontal shaft, a bed above the cutter, said bed having a port through which the periphery of the cutting mill is exposed, a bale cradle above the bed, means for depositing bales of such stacked wood pulp sheets into said cradle to dispose a portion of the face of such stack against the periphery of the cutting mill through said port, and power means for rotating the cradle and contained bale on a vertical axis and producing relative motion in the plane of said face between the stack face and said cutter to sweep all portions of said face over said port and against said cutter, in combination with conveyor means to supply fresh bales to said cradle as a partially exhausted bale in the cradle is reduced in height by the action of the cutting mill, said conveyor means including means to advance a fresh bale to a position above said cradle and deposit said fresh bale into said cradle on top of a partially exhausted bale in said cradle.

15. The apparatus of claim 14 in combination with aligning means for aligning the cradle with the fresh bale thereabove so that the fresh bale will properly fit in said cradle when deposited therein.

16. The apparatus of claim 15 in which said aligning means comprises sensing means for sensing when the partially exhausted bale has been reduced to a predetermined height, control means for stopping rotation of said cradle in alignment with the fresh bale, depositing the fresh bale into the cradle and resuming rotation of said cradle.

17. The apparatus of claim 16 in which said cradle is mounted in a tub, said sensing means comprising a photocell and light source at opposite sides and outside the tub, said tub having sighting ports in its side wall for transmission of light from said source to said photocell.

* * * * *